US010611434B2

(12) United States Patent
Beardmore

(10) Patent No.: US 10,611,434 B2
(45) Date of Patent: Apr. 7, 2020

(54) BILGE PUMP BREAKOUT BOX AND ASSOCIATED METHODS

(71) Applicant: Douglas Charles Beardmore, Melbourne Beach, FL (US)

(72) Inventor: Douglas Charles Beardmore, Melbourne Beach, FL (US)

( * ) Notice: Subject to any disclaimer, the term of this patent is extended or adjusted under 35 U.S.C. 154(b) by 356 days.

(21) Appl. No.: 15/834,188

(22) Filed: Dec. 7, 2017

(65) Prior Publication Data

US 2018/0178884 A1 Jun. 28, 2018

Related U.S. Application Data

(60) Provisional application No. 62/439,167, filed on Dec. 27, 2016.

(51) Int. Cl.

| | |
|---|---|
| ***G01R 31/02*** | (2006.01) |
| ***G01R 31/327*** | (2006.01) |
| ***B63B 13/00*** | (2006.01) |
| *B63J 4/00* | (2006.01) |

(52) U.S. Cl.
CPC ..... *B63B 13/00* (2013.01); *B63J 4/00* (2013.01)

(58) Field of Classification Search
CPC ..... G01R 31/02; G01R 31/04; B63B 17/00; B63B 13/00; B63J 4/00; B63J 4/004; G08B 21/20; F04D 15/02; F04D 15/0218
See application file for complete search history.

(56) References Cited

U.S. PATENT DOCUMENTS 6,490,986 B1 * 12/2002 Sherdel ..... B63B 17/00 114/183 R
7,661,380 B2 * 2/2010 Waldecker ..... B63J 4/004 114/183 R

* cited by examiner

*Primary Examiner* — Minh N Tang
(74) *Attorney, Agent, or Firm* — Mark Malek; Paul J. Ditmyer; Widerman Malek, PL

(57) ABSTRACT

A bilge pump breakout box is for connection to a bilge pump system that includes a bilge pump, a power supply, a manual on/off switch, and a float switch. The bilge pump breakout box includes a dielectric substrate, and a terminal block positioned on a first side of the substrate and including a plurality of electrical connection terminals configured to be electrically coupled to the bilge pump, the power supply, the manual on/off switch, and the float switch. Each of the plurality of electrical connection terminals includes a wire connector at a first end, and a connection pin at a second end and extending through the dielectric substrate. Connection circuitry is positioned on a second side of the dielectric substrate and electrically connecting various connection pins of the plurality of electrical connection terminals in a circuit pattern. A protective enclosure protects the components from the ambient environment.

20 Claims, 8 Drawing Sheets

BILGE PUMP BREAKOUT BOX AND ASSOCIATED METHODS

RELATED APPLICATIONS

This application claims the benefit under 35 U.S.C. § 119(e) of U.S. Provisional Patent Application Ser. No. 62/439,167 filed on Dec. 27, 2016 and titled BILGE PUMP BREAKOUT BOX, the entire content(s) of which is/are incorporated herein by reference

FIELD OF THE INVENTION

The present invention relates to systems and methods for watercraft systems, and particularly to electrical circuitry and systems for operation of a bilge pump system in a watercraft.

BACKGROUND

Pleasure boats are built with one or two bilge pumps, for example. Each pump system typically has a manual ON switch, a float switch which detects water in the bilge, and a 12-24 volt bilge pump.

The wires connected between the power supply, the manual switch, the float switch, and the bilge pump are connected together in the bilge of the boat. There are many ways to connect the components of a bilge pump system. However, a common problem is twofold. Firstly, the installer must reach into the bilge to connect the wires to the components and wrap tape around the connections to prevent corrosion. This is quite awkward. Also, when it comes time to trouble shoot a bilge pump system problem, the technician has to reach into the bilge and unwrap the tape, or disconnect wires to expose the various wires and connection to check with a volt meter to determine if there is a defective component. This procedure is awkward and time consuming.

Accordingly, there is a need for a bilge pump breakout box to aid in the installation and troubleshooting a bilge pump system.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a bilge pump breakout box and method to aid in the installation and troubleshooting of a bilge pump system for a watercraft. An object of the present embodiments is to ease the process and reduce the time needed for troubleshooting a bilge pump system.

An embodiment of the present invention is directed to a bilge pump breakout box for connection to a bilge pump breakout box for connection to a bilge pump system includes a bilge pump, a power supply, a manual on/off switch, and a float switch. The bilge pump breakout box may include a dielectric substrate, and a terminal block positioned on a first side of the substrate and including a plurality of electrical connection terminals configured to be electrically coupled to the bilge pump, the power supply, the manual on/off switch, and the float switch. Each of the plurality of electrical connection terminals may include a wire connector at a first end, and a connection pin at a second end and extending through the dielectric substrate. Connection circuitry is positioned on a second side of the dielectric substrate and electrically connecting various connection pins of the plurality of electrical connection terminals in a circuit pattern. A protective enclosure encloses the dielectric substrate, terminal block and connection circuitry and is configured to protect such from an ambient environment.

Additionally, and/or alternatively, visual indicators may be included on at least one of the dielectric substrate and terminal block to respectively identify each of the plurality of electrical connection terminals with respect to the bilge pump, the power supply, the manual on/off switch, and the float switch of the bilge pump system.

Additionally, and/or alternatively, the dielectric substrate may be a nylon substrate.

Additionally, and/or alternatively, the plurality of electrical connection terminals may include seven electrical connection terminals. Furthermore, the seven electrical connection terminals may include a first float switch connection terminal, a second float switch connection terminal, a positive bilge pump connection terminal, a negative bilge pump connection terminal, a positive power supply connection terminal, a negative power supply connection terminal, and a manual on/off switch connection terminal. Also, the connection circuitry may include a first channel connecting the first float switch connection terminal to the positive power supply connection terminal, a second channel connecting the second float switch connection terminal to the positive bilge pump connection terminal and the manual on/off switch connection terminal, and a third channel connecting the negative bilge pump connection terminal to the negative power supply connection terminal. The connection circuitry may include an integrated circuit patterned on the second side of the dielectric substrate to define the first, second and third channels. Here, each of the connection pins may be soldered to the integrated circuit.

Additionally, and/or alternatively, each of the wire connectors may be a screw connector configured to releasably hold a wire configured to be electrically coupled to the bilge pump, the power supply, the manual on/off switch, and the float switch, respectively.

Additionally, and/or alternatively, the protective enclosure may be a PVC enclosure having at least a portion that is transparent for visual inspection of the dielectric substrate, terminal block and connection circuitry.

Another embodiment is directed to a bilge pump breakout box for connection to a bilge pump system including a bilge pump, a power supply, a manual on/off switch, and a float switch. The bilge pump breakout box includes a terminal block with a plurality of electrical connection terminals configured to be electrically coupled to the bilge pump, the power supply, the manual on/off switch, and the float switch. The electrical connection terminals may at least include a first float switch connection terminal, a second float switch connection terminal, a positive bilge pump connection terminal, a negative bilge pump connection terminal, a positive power supply connection terminal, a negative power supply connection terminal, and a manual on/off switch connection terminal. Connection circuitry electrically connects various electrical connection terminals in a circuit pattern that at least includes a first channel connecting the first float switch connection terminal to the positive power supply connection terminal, a second channel connecting the second float switch connection terminal to the positive bilge pump connection terminal and the manual on/off switch connection terminal, and a third channel connecting the negative bilge pump connection terminal to the negative power supply connection terminal. Also, a protective enclosure encloses the terminal block and connection circuitry and is configured to protect such from an ambient environment.

Additionally, and/or alternatively, visual indicators may be associated with the terminal block to respectively identify each of the plurality of electrical connection terminals with respect to the bilge pump, the power supply, the manual on/off switch, and the float switch of the bilge pump system.

Additionally, and/or alternatively, the connection circuitry may be an integrated circuit patterned on a dielectric substrate to define the first, second and third channels. Each of the electrical connection terminals may include a connection pin that is soldered to the integrated circuit.

Additionally, and/or alternatively, each of the electrical connection terminals may include a screw connector configured to releasably hold a wire configured to be electrically coupled to the bilge pump, the power supply, the manual on/off switch, and the float switch, respectively.

Another embodiment is directed to a method of troubleshooting a bilge pump system including a bilge pump, a power supply, a manual on/off switch, and a float switch, and a bilge pump breakout box comprising a terminal block including a plurality of electrical connection terminals electrically coupled to the bilge pump, the power supply, the manual on/off switch, and the float switch. The bilge pump breakout box includes connection circuitry electrically connecting the electrical connection terminals in a circuit pattern that at least includes a first channel connecting a first float switch connection terminal to a positive power supply connection terminal, a second channel connecting a second float switch connection terminal to a positive bilge pump connection terminal and a manual on/off switch connection terminal, and a third channel connecting a negative bilge pump connection terminal to a negative power supply connection terminal, the bilge pump breakout box being enclosed in a protective enclosure for protection from an ambient environment. The method includes: opening the protective enclosure to access the bilge pump breakout box; using a volt meter to measure a voltage between the positive power supply connection terminal and the negative power supply connection terminal; using the volt meter to measure a voltage between the manual on/off switch connection terminal and the negative power supply terminal; validating operation of the float switch by coupling a first electrical jumper between the first and second float switch connection terminals; and validating operation of the bilge pump by coupling a second electrical jumper between the positive power supply connection terminal and the positive bilge pump connection terminal.

Additionally, and/or alternatively, the bilge pump breakout box may further include visual indicators associated with the terminal block to respectively identify each of the plurality of electrical connection terminals with respect to the bilge pump, the power supply, the manual on/off switch, and the float switch of the bilge pump system.

Additionally, and/or alternatively, the connection circuitry may be an integrated circuit patterned on a dielectric substrate to define the first, second and third channels. Also, each of the electrical connection terminals may include a connection pin that is soldered to the integrated circuit.

Additionally, and/or alternatively, each of the electrical connection terminals includes a screw connector configured to releasably hold a wire electrically coupled to the bilge pump, the power supply, the manual on/off switch, and the float switch, respectively.

DETAILED DESCRIPTION OF THE INVENTION

Figure 1:
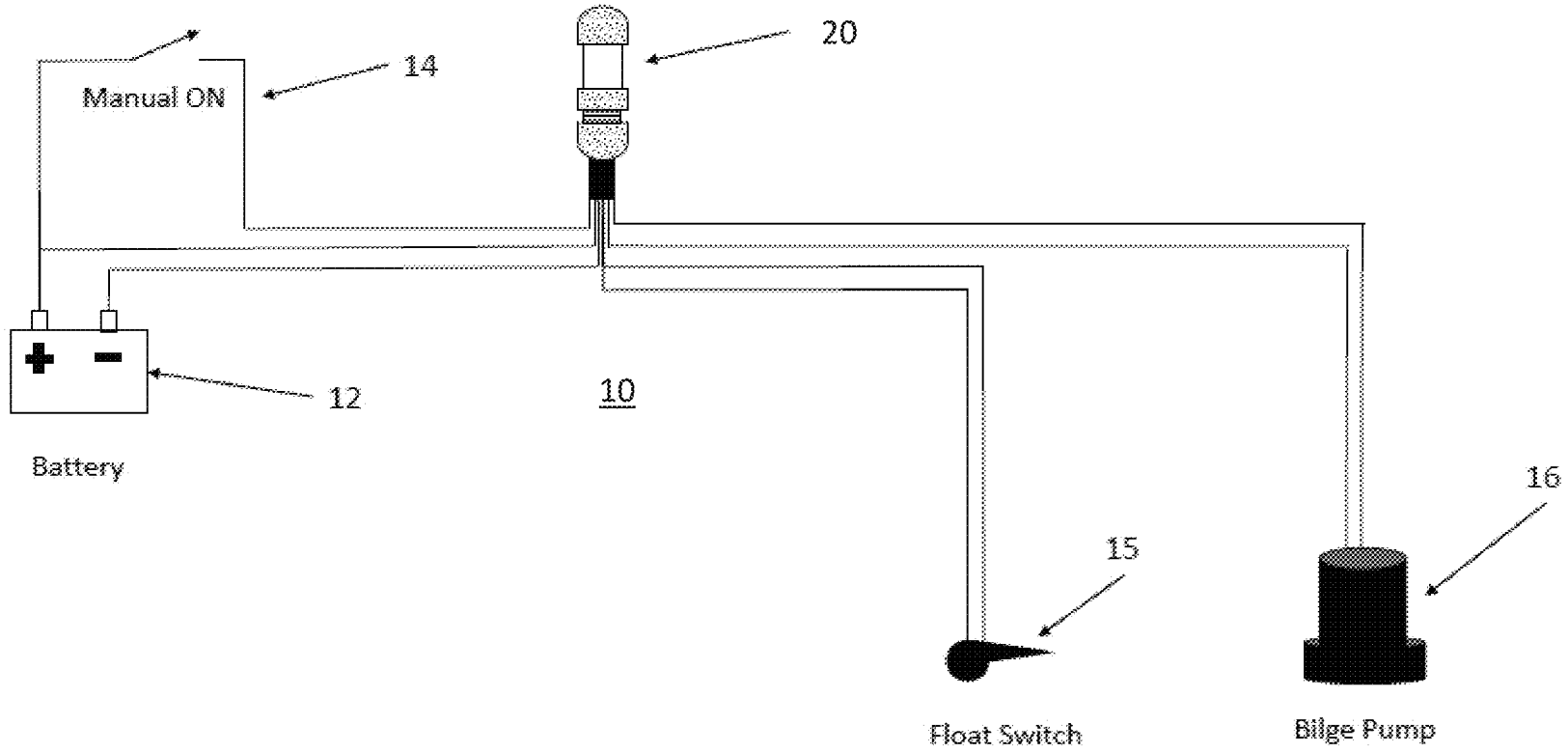
FIG. 1 is a schematic representation of an embodiment of the overall circuit of a bilge pump system including a bilge pump breakout box according to features of the present invention.
Figure 2:
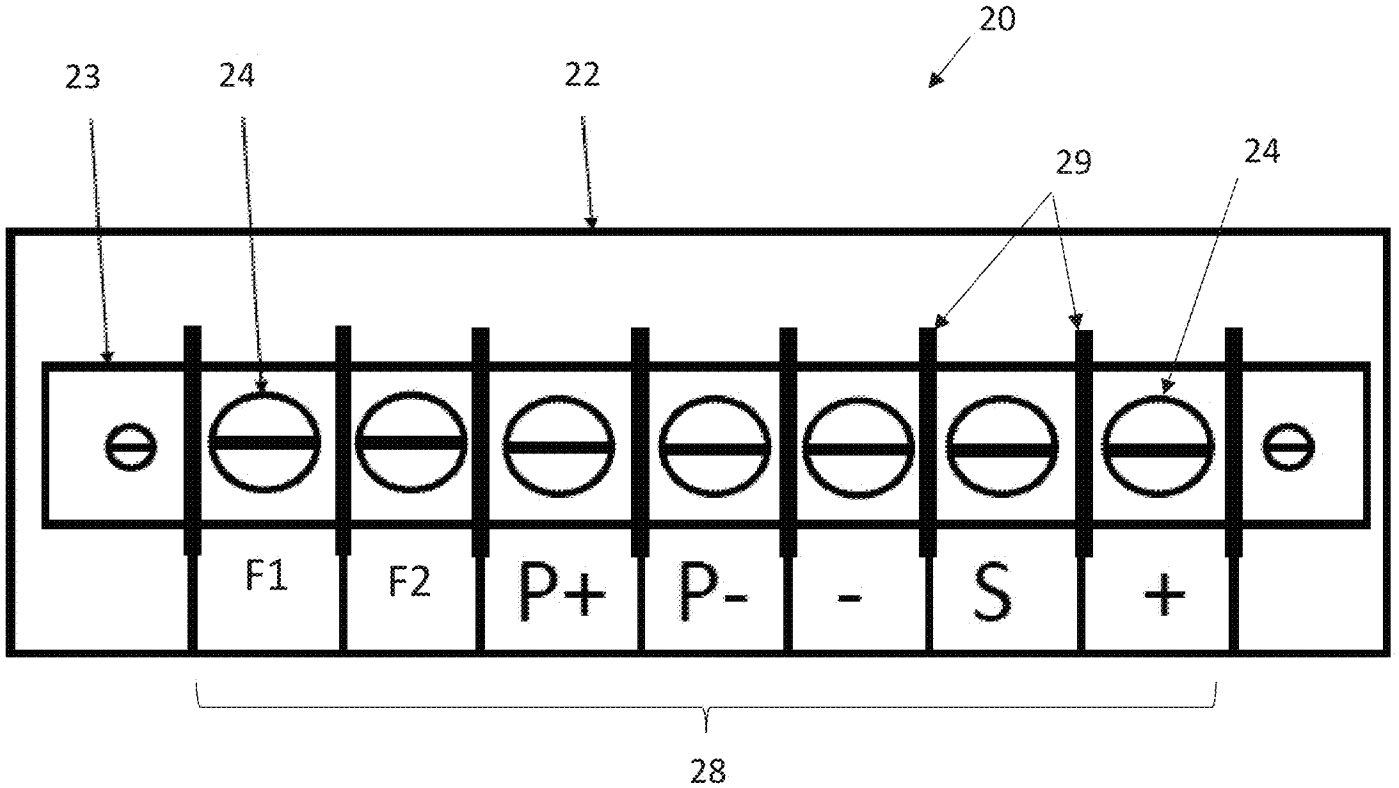
FIG. 2 is a top view of an embodiment of the bilge pump breakout box according to features of the present invention and showing the terminal block, the fasteners (e.g., seven screws) and the markings labeling each terminal.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Referring now to FIGS. 1-5, an embodiment of a bilge pump breakout box 20 for connection and operation with a bilge pump system 10 will now be described. A typical bilge pump system 10 includes a power supply 12, such as a battery, a manual on/off switch 14 (e.g. positioned at the console of the watercraft, not shown), a float switch 15 (positioned in the bilge to detect water) and a bilge pump 16. Such components are typically electrically coupled to each as would be appreciated by those skilled in the art.

The power supply 12 supplies power for the bilge pump system 10. The manual on/off switch 14 is generally located on the console of the boat. The float switch 15 is generally located in the lowest point in the bilge. The bilge pump 16 is also located at the lowest point in the bilge. The bilge pump breakout box 20 is electrically coupled within the bilge pump system 10, as will be described in detail below.

The bilge pump breakout box 20 is located at the highest point in the bilge. Extra wire length is recommended when installing the bilge pump breakout box 20. This feature allows the technician to remove the bilge pump breakout box 20 from the bilge and lay it on the floor of the boat. Once on the floor of the boat, a protective enclosure 60 can be opened for access to trouble shoot the bilge pump system 10, as will be described below.

The bilge pump breakout box 20 includes a dielectric substrate 22, and a terminal block 23 positioned on a first side (e.g., a top) of the substrate 22 and including a plurality of electrical connection terminals 24 configured to be electrically coupled to the bilge pump 16, the power supply 12, the manual on/off switch 14, and the float switch 15. Each of the plurality of electrical connection terminals 24 includes a wire connector 25 at a first end, and a connection pin 26 at a second end and extending through the dielectric substrate 22. Connection circuitry 27 is positioned on a second side (e.g. a bottom) of the dielectric substrate 22 and electrically connects various connection pins 26 of the plurality of electrical connection terminals 24 in a circuit pattern.

Figure 6:
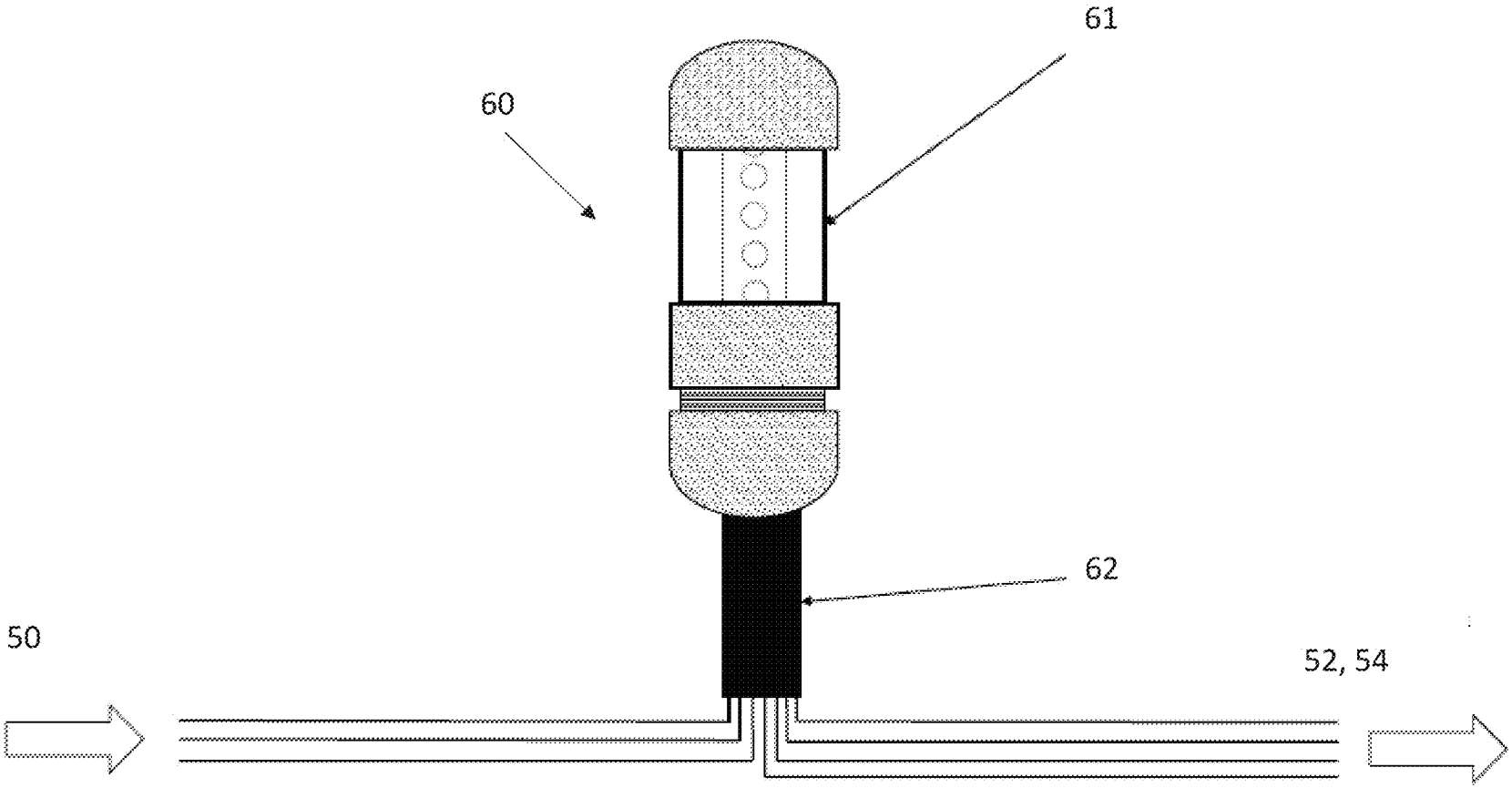
FIG. 6 is a schematic representation of an embodiment of the protective enclosure for the bilge pump breakout box of FIG. 2.

A protective enclosure 60 (e.g., as shown in FIG. 6) encloses the dielectric substrate 22, terminal block 23 and connection circuitry 27 and is configured to protect such from an ambient environment. The protective enclosure 60 may be a PVC enclosure having at least a portion that is transparent for visual inspection of the dielectric substrate 22, terminal block 23 and connection circuitry 27.

Furthermore, the seven electrical connection terminals 24 may include a first float switch connection terminal F1, a second float switch connection terminal F2, a positive bilge pump connection terminal P+, a negative bilge pump connection terminal P−, a positive power supply connection terminal+, a negative power supply connection terminal−, and a manual on/off switch connection terminal S. Also, the connection circuitry 27 may include a first channel 30 connecting the first float switch connection terminal F to the positive power supply connection terminal+, a second channel 32 connecting the second float switch connection terminal F to the positive bilge pump connection terminal P+ and the manual on/off switch connection terminal S, and a third channel 34 connecting the negative bilge pump connection terminal P− to the negative power supply connection terminal−. The connection circuitry 27 may be an integrated circuit patterned on the bottom of the dielectric substrate 22 to define the first 30, second 32 and third channels 34.

Visual indicators 28 may be included on the dielectric substrate 22 and/or terminal block 23 to respectively identify each of the plurality of electrical connection terminals 24 with respect to the bilge pump 16, the power supply 12, the manual on/off switch 14, and the float switch 15 of the bilge pump system 10. For example, as illustrated, F denotes the connection points for the two wires of the float switch 15, P+ denotes the connection point for the 12-24 volt positive power to the bilge pump 16, P− denotes the connection point for the negative power to the bilge pump 16, + denotes the connection point for the positive power supply (e.g., 12-24 volts) from the power supply 12 (battery), − denotes the connection point for the ground from the power supply 12, and S denotes the connection point for the manual on/off switch 14 positive power (e.g., 12-24 volts) from the control panel on the console of the boat. The visual indicators 28 or markings that identify the connection terminals 24 of the terminal block 23 aid in the ease of installation and troubleshooting of the bilge pump system 10, as will be discussed in further detail below.

As an example, the terminal block 23 may be a commercially available terminal block (or a custom terminal block) with seven electrical connection terminals 24 that are typically isolated from each other by dielectric dividers 29 having screw connectors (as the wire connectors 25, for example) on the top of the terminal block 23, and solder turrets (as the connection pins 26, for example) on the bottom of the terminal block 23 protruding thru the dielectric substrate 22.

Figure 3:
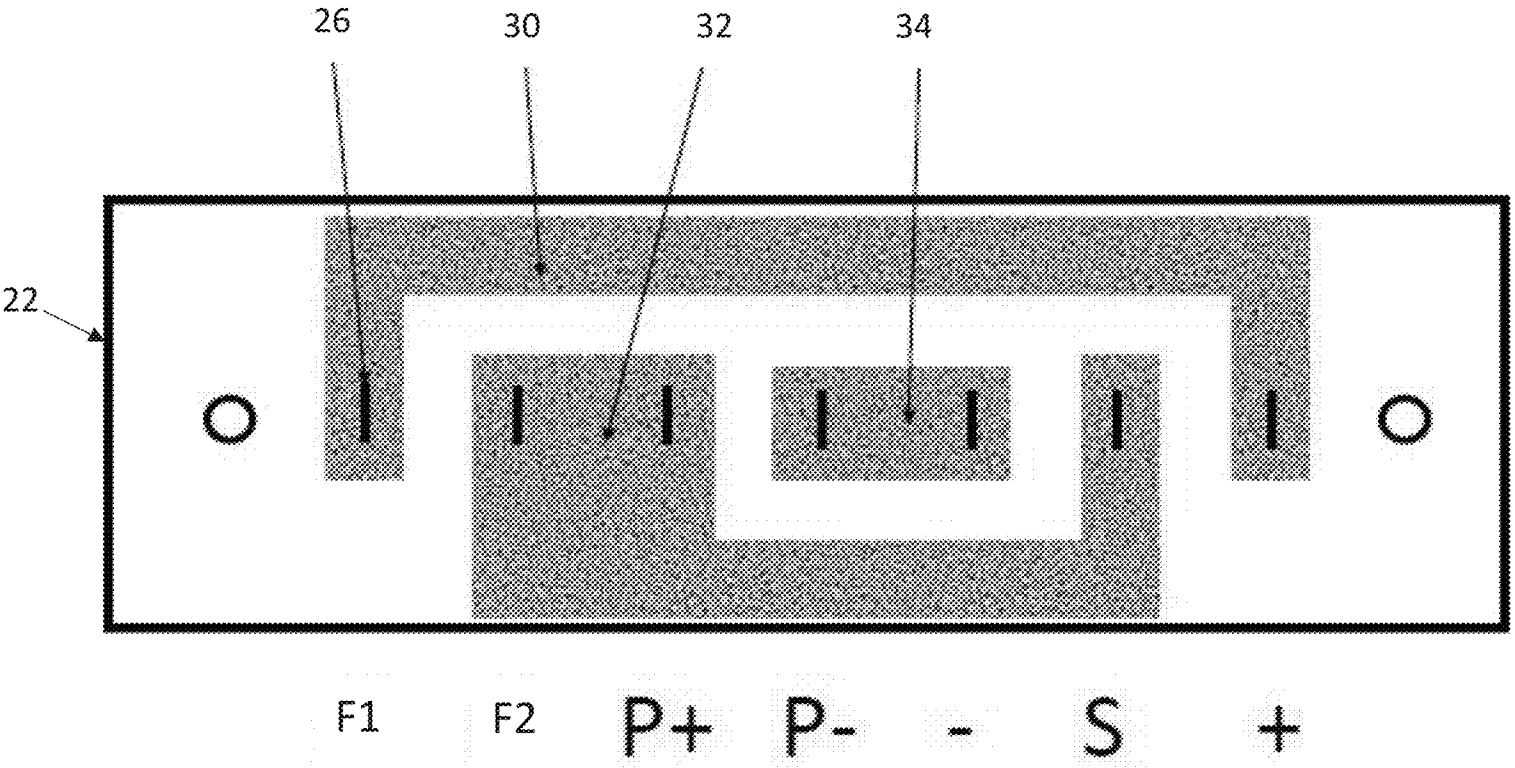
FIG. 3 is a bottom view of the bottom of the bilge pump breakout box of FIG. 2 and showing the channels of the connection circuitry.
Figure 4:
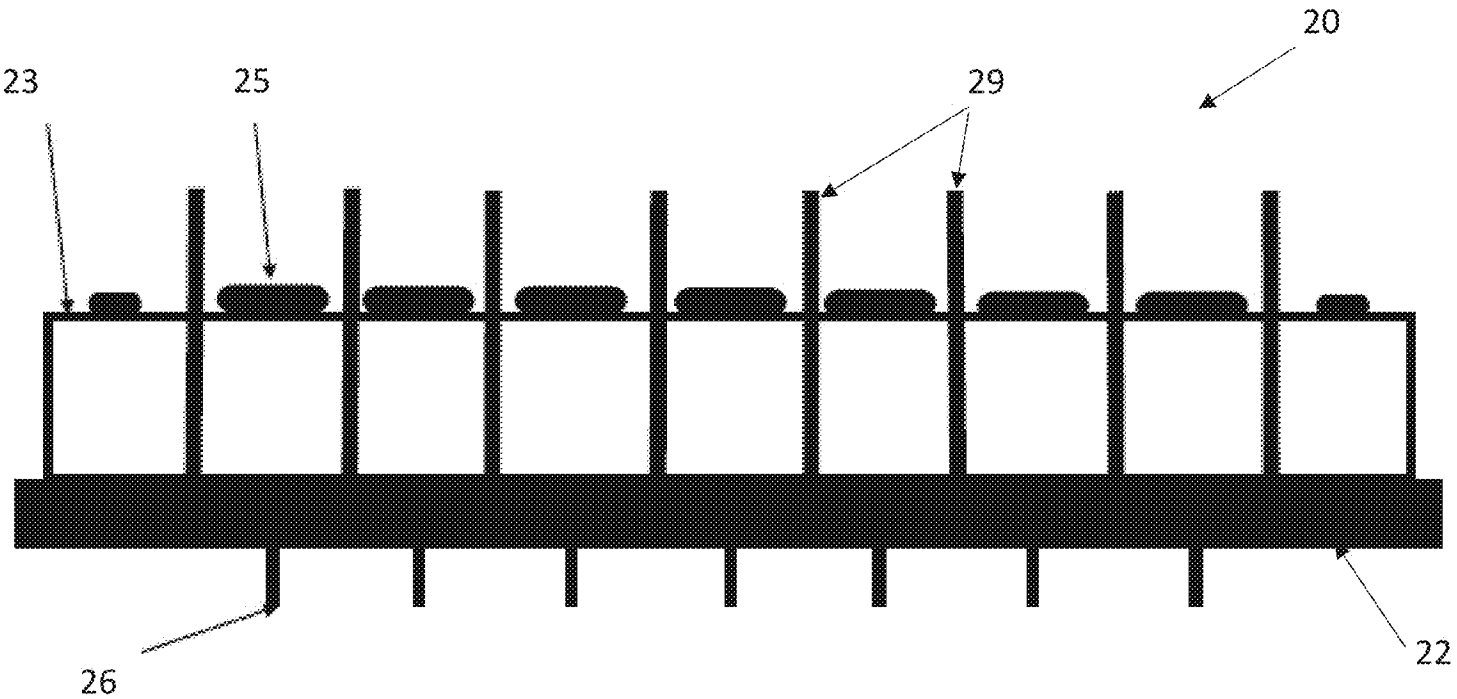
FIG. 4 is a side view of the bilge pump breakout box of FIG. 2 and showing the terminal block mounted on top of the dielectric substrate with the channels of the connection circuitry on the bottom thereof.

The dielectric substrate 22 may be a nylon substrate. The connection circuitry 27 may be defined by the circuit channels 30, 32, 34 (FIG. 3) that are attached to bottom of the substrate 22, and electrically coupled (e.g., soldered) to the connection pins 26 of the terminal block 23. FIG. 3 shows the circuit channels 30, 32, 34 as a patterned integrated circuit on the bottom of the substrate 22. The channels may be copper, for example. Thus, integrated circuit channel 30 connects terminals F, +; integrated circuit channel 32 connects terminals F, P+, S; and integrated circuit channel 34 connects terminals P−, −.

As described, each of the wire connectors 25 may be a screw connector configured to releasably hold a wire configured to be electrically coupled to the bilge pump 16, the power supply 12, the manual on/off switch 14, and the float switch 15, respectively.

Figure 5:
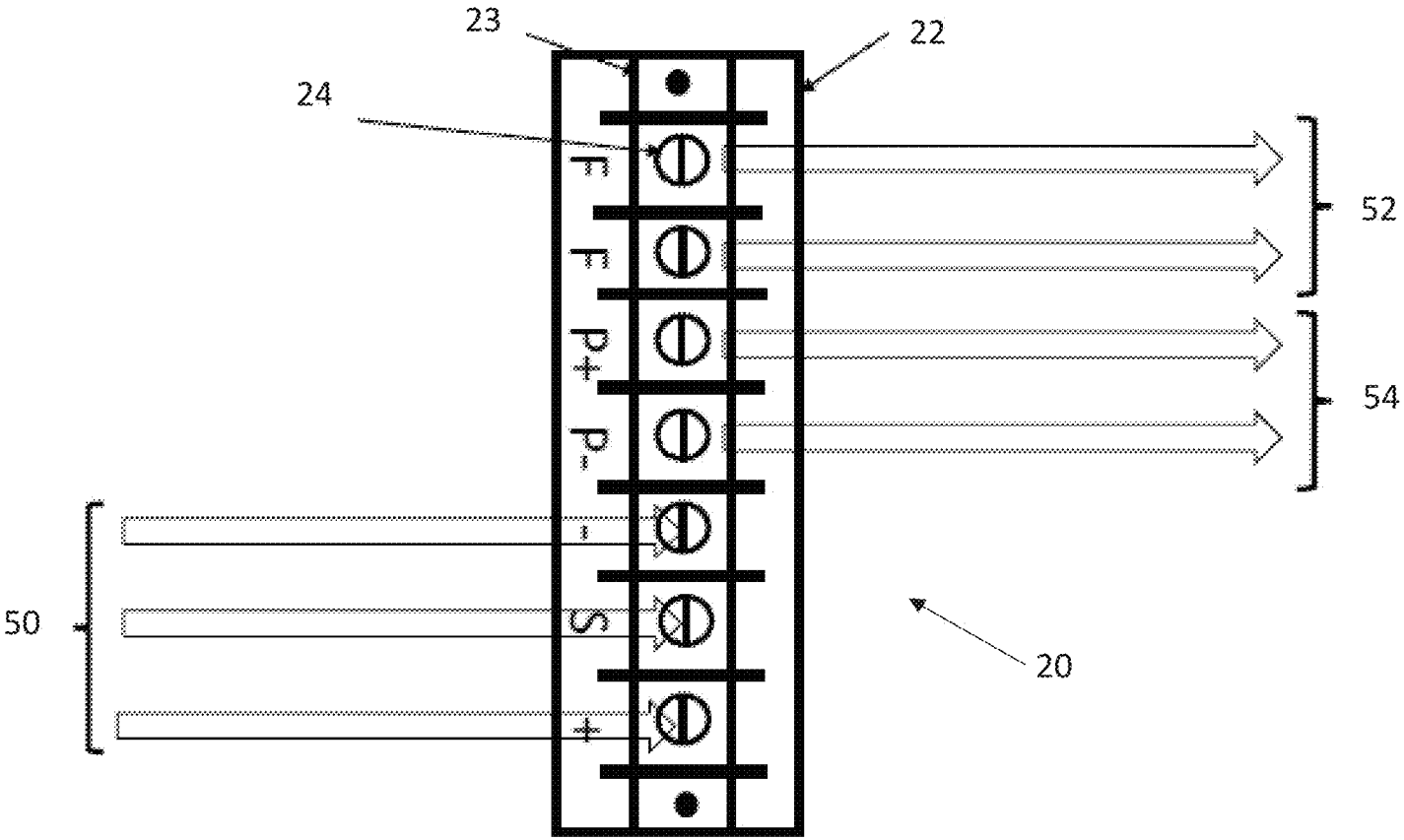
FIG. 5 is a schematic representation of an embodiment of a wiring diagram of the bilge pump breakout box of FIG. 2.

FIG. 5 shows an example of the wires of the bilge pump system 10 leading to and from the bilge pump breakout box 20. The power wires 50, positive+(e.g., 12-24 volts), ground−, and manual switched power S are respectively connected to the electrical connection terminals 24 at the terminal block 23 as discussed above. The wires 52 to the float switch 15 are respectively connected to the electrical connection terminals 24 at the terminal block 23 as discussed above. The wires 54 to the bilge pump 16 are respectively connected to the electrical connection terminals 24 at the terminal block 23 as discussed above.

FIG. 6 shows an example of the protective enclosure 60, illustrated as a PVC enclosure compartment including, for example, a tubular piece of clear PVC 61. This feature allows a technician to easily view the integrity of the circuitry, for example, with respect to possible corrosion of the terminal block connection terminals 24 and the integrated circuit channels 30, 32, 34. The protective enclosure 60 is to protect the terminal block 23 and connection circuitry 24 from the water and/or salty air in the bilge of the boat. The protective enclosure 60 may also include a rubber tubing 62 for the wires 50, 52, 54 to enter and exit the enclosure 60. The rubber tubing 62 can be secured, for example, with a tie-wrap firmly wrapped around the rubber tubing 62.

Figure 7:
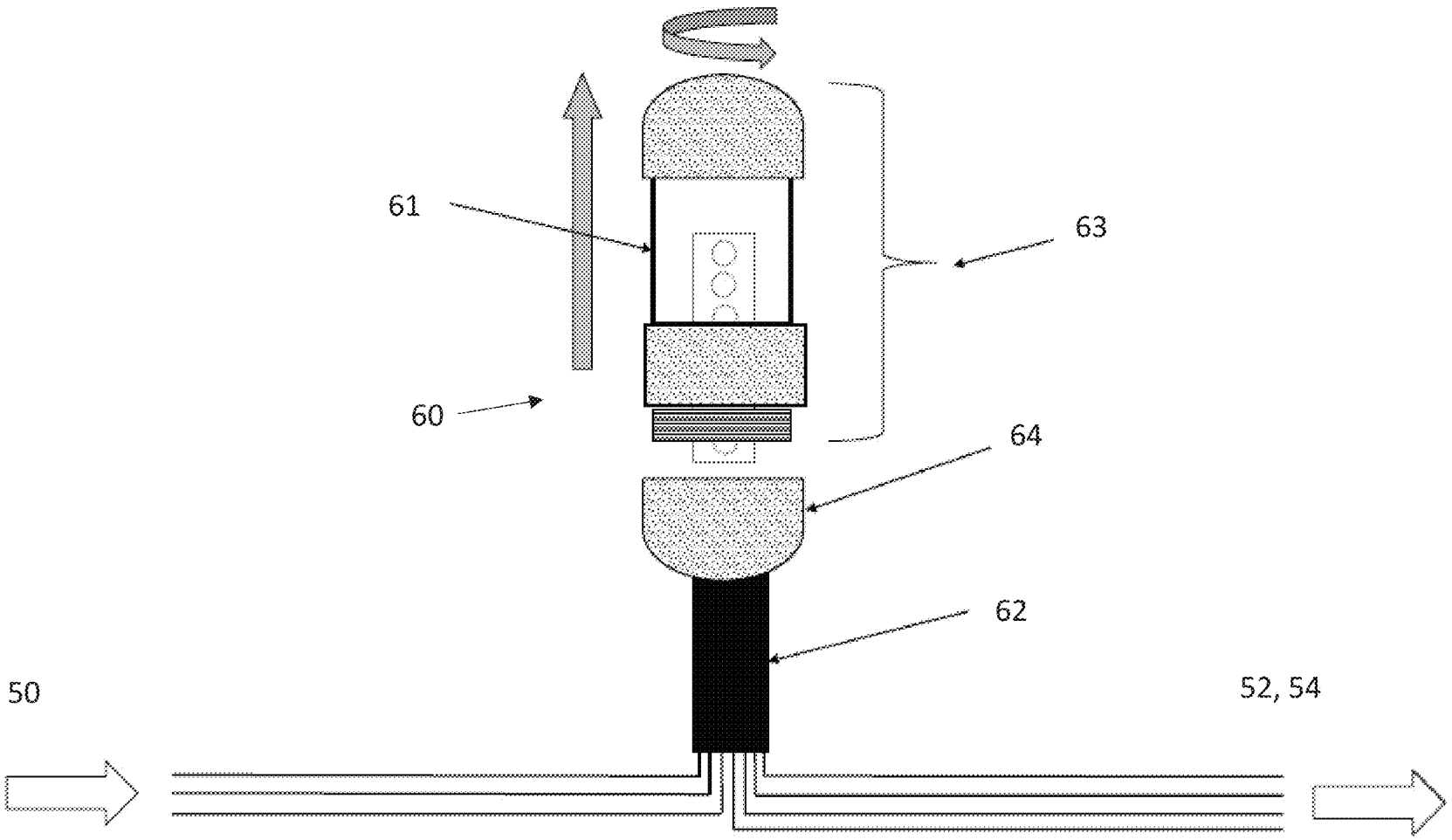
FIG. 7 is a schematic representation of an embodiment of the protective enclosure for the bilge pump breakout box of FIG. 2 being opened to access the terminal block.

FIG. 7 shows an example of how the protective enclosure 60 can be opened to access the terminal block 23. The upper half 63 (e.g., including the clear PVC 61) of the protective enclosure 60 may unscrew from the lower half 64.

Figure 8:
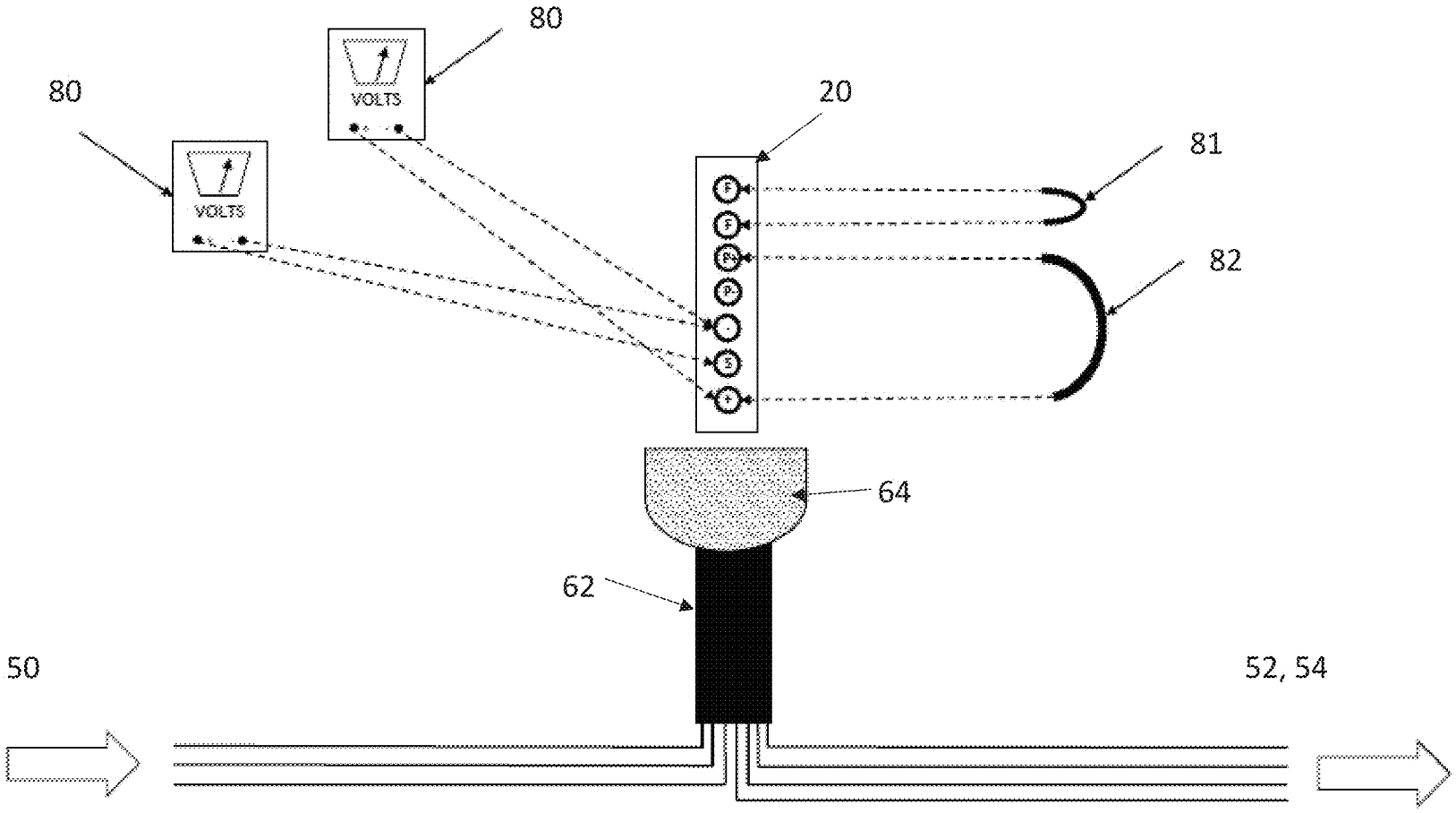
FIG. 8 is a schematic representation of an embodiment of the method for troubleshooting a bilge pump system including use of the bilge pump breakout box of FIG. 2, a volt meter and electrical jumpers.

FIG. 8 is a schematic diagram illustrating how to trouble shoot a bilge pump system in accordance with features of the present invention. The method includes: opening the protective enclosure 60 to access the bilge pump breakout box 20 (as shown in FIG. 7); using a volt meter 80 to measure a voltage between the positive power supply connection terminal+ and the negative power supply connection terminal−; using the volt meter 80 to measure a voltage between the manual on/off switch connection terminal S and the negative power supply terminal−; validating operation of the float switch 15 by coupling a first electrical jumper 81 between the first F1 and second F2 float switch connection terminals; and validating operation of the bilge pump 16 by coupling a second electrical jumper 82 between the positive power supply connection terminal+ and the positive bilge pump connection terminal P+ (i.e., using jumper 82 to route power directly to the bilge pump 16 to validate the integrity of the bilge pump).

While the specific embodiments of the present invention have been described, it will be apparent to those skilled in the art that various modifications thereto can be made without departing from the spirit and scope of the invention as defined in the appended claims. Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A bilge pump breakout box for connection to a bilge pump system including a bilge pump, a power supply, a manual on/off switch, and a float switch, the bilge pump breakout box comprising:

a dielectric substrate;

a terminal block positioned on a first side of the substrate and including a plurality of electrical connection terminals configured to be electrically coupled to the bilge pump, the power supply, the manual on/off switch, and the float switch;

each of the plurality of electrical connection terminals including a wire connector at a first end, and a connection pin at a second end and extending through the dielectric substrate;

connection circuitry positioned on a second side of the dielectric substrate and electrically connecting various connection pins of the plurality of electrical connection terminals in a circuit pattern; and a protective enclosure enclosing the dielectric substrate, terminal block and connection circuitry and configured to protect such from an ambient environment.

2. The bilge pump breakout box according to claim 1, further comprising visual indicators on at least one of the dielectric substrate and terminal block to respectively identify each of the plurality of electrical connection terminals with respect to the bilge pump, the power supply, the manual on/off switch, and the float switch of the bilge pump system.

3. The bilge pump breakout box according to claim 1, wherein the dielectric substrate comprises a nylon substrate.

4. The bilge pump breakout box according to claim 1, wherein the plurality of electrical connection terminals comprises seven electrical connection terminals.

5. The bilge pump breakout box according to claim 4, wherein the seven electrical connection terminals include a first float switch connection terminal, a second float switch connection terminal, a positive bilge pump connection terminal, a negative bilge pump connection terminal, a positive power supply connection terminal, a negative power supply connection terminal, and a manual on/off switch connection terminal.

6. The bilge pump breakout box according to claim 5, wherein the connection circuitry includes a first channel connecting the first float switch connection terminal to the positive power supply connection terminal, a second channel connecting the second float switch connection terminal to the positive bilge pump connection terminal and the manual on/off switch connection terminal, and a third channel connecting the negative bilge pump connection terminal to the negative power supply connection terminal.

7. The bilge pump breakout box according to claim 6, wherein the connection circuitry comprises an integrated circuit patterned on the second side of the dielectric substrate to define the first, second and third channels.

8. The bilge pump breakout box according to claim 7, wherein each of the connection pins is soldered to the integrated circuit.

9. The bilge pump breakout box according to claim 1, wherein each of the wire connectors comprises a screw connector configured to releasably hold a wire configured to be electrically coupled to the bilge pump, the power supply, the manual on/off switch, and the float switch, respectively.

10. The bilge pump breakout box according to claim 1, wherein the protective enclosure comprises a PVC enclosure having at least a portion that is transparent for visual inspection of the dielectric substrate, terminal block and connection circuitry.

11. A bilge pump breakout box for connection to a bilge pump system including a bilge pump, a power supply, a manual on/off switch, and a float switch, the bilge pump breakout box comprising:

a terminal block including a plurality of electrical connection terminals configured to be electrically coupled to the bilge pump, the power supply, the manual on/off switch, and the float switch;

the electrical connection terminals at least including a first float switch connection terminal, a second float switch connection terminal, a positive bilge pump connection terminal, a negative bilge pump connection terminal, a positive power supply connection terminal, a negative power supply connection terminal, and a manual on/off switch connection terminal;

connection circuitry electrically connecting various electrical connection terminals in a circuit pattern that at least includes a first channel connecting the first float switch connection terminal to the positive power supply connection terminal, a second channel connecting the second float switch connection terminal to the positive bilge pump connection terminal and the manual on/off switch connection terminal, and a third channel connecting the negative bilge pump connection terminal to the negative power supply connection terminal; and a protective enclosure enclosing the terminal block and connection circuitry and configured to protect such from an ambient environment.

12. The bilge pump breakout box according to claim 11, further comprising visual indicators associated with the terminal block to respectively identify each of the plurality of electrical connection terminals with respect to the bilge pump, the power supply, the manual on/off switch, and the float switch of the bilge pump system.

13. The bilge pump breakout box according to claim 11, wherein the connection circuitry comprises an integrated circuit patterned on a dielectric substrate to define the first, second and third channels.

14. The bilge pump breakout box according to claim 13, wherein each of the electrical connection terminals includes a connection pin that is soldered to the integrated circuit.

15. The bilge pump breakout box according to claim 11, wherein each of the electrical connection terminals includes a screw connector configured to releasably hold a wire configured to be electrically coupled to the bilge pump, the power supply, the manual on/off switch, and the float switch, respectively.

16. A method of troubleshooting a bilge pump system including a bilge pump, a power supply, a manual on/off switch, and a float switch, and a bilge pump breakout box comprising a terminal block including a plurality of electrical connection terminals electrically coupled to the bilge pump, the power supply, the manual on/off switch, and the float switch, the bilge pump breakout box including connection circuitry electrically connecting the electrical connection terminals in a circuit pattern that at least includes a first channel connecting a first float switch connection terminal to a positive power supply connection terminal, a second channel connecting a second float switch connection terminal to a positive bilge pump connection terminal and a manual on/off switch connection terminal, and a third channel connecting a negative bilge pump connection terminal to a negative power supply connection terminal, the bilge pump breakout box being enclosed in a protective enclosure for protection from an ambient environment, the method comprising:

opening the protective enclosure to access the bilge pump breakout box;

using a volt meter to measure a voltage between the positive power supply connection terminal and the negative power supply connection terminal;

using the volt meter to measure a voltage between the manual on/off switch connection terminal and the negative power supply terminal;

validating operation of the float switch by coupling a first electrical jumper between the first and second float switch connection terminals; and validating operation of the bilge pump by coupling a second electrical jumper between the positive power supply connection terminal and the positive bilge pump connection terminal.

17. The method according to claim 16, wherein the bilge pump breakout box further includes visual indicators associated with the terminal block to respectively identify each of the plurality of electrical connection terminals with respect to the bilge pump, the power supply, the manual on/off switch, and the float switch of the bilge pump system.

18. The method according to claim 16, wherein the connection circuitry comprises an integrated circuit patterned on a dielectric substrate to define the first, second and third channels.

19. The method according to claim 18, wherein each of the electrical connection terminals includes a connection pin that is soldered to the integrated circuit.

20. The method according to claim 16, wherein each of the electrical connection terminals includes a screw connector configured to releasably hold a wire electrically coupled to the bilge pump, the power supply, the manual on/off switch, and the float switch, respectively.

* * * * *